United States Patent [19]

Ojanen

[11] Patent Number: 4,836,614

[45] Date of Patent: Jun. 6, 1989

[54] RETAINER SCHEME FOR MACHINE BIT

[75] Inventor: Randall W. Ojanen, Bristol, Tenn.

[73] Assignee: GTE Products Corporation, Danvers, Mass.

[21] Appl. No.: 800,589

[22] Filed: Nov. 21, 1985

[51] Int. Cl.[4] ..... E21C 35/18

[52] U.S. Cl. ..... 299/86; 175/354; 175/410; 299/92

[58] Field of Search ..... 299/86, 92; 175/354, 175/410; 279/103

[56] References Cited

U.S. PATENT DOCUMENTS

| | | | |
|---|---|---|---|
| 3,397,012 | 8/1968 | Krekeler | 299/86 |
| 3,663,063 | 5/1972 | Johnmeyer, Sr. | 299/86 |
| 4,084,856 | 4/1978 | Emmerich et al. | 299/86 |
| 4,149,753 | 4/1979 | Stoltz et al. | 299/91 |
| 4,201,421 | 5/1980 | Den Besten et al. | 299/86 |
| 4,333,687 | 6/1982 | Barnstorf | 299/86 X |
| 4,484,783 | 11/1984 | Emmerich | 299/86 |
| 4,561,698 | 12/1985 | Beebe | 299/86 |
| 4,603,911 | 8/1986 | Hindmarsh et al. | 299/86 X |

FOREIGN PATENT DOCUMENTS

| | | |
|---|---|---|
| 646047 | 2/1979 | U.S.S.R. . |
| 2041289 | 9/1980 | United Kingdom . |

*Primary Examiner*—Z. R. Bilinsky
*Attorney, Agent, or Firm*—David J. Koris

[57] ABSTRACT

A rotatable cutting tool of the type having a bored tool holder, a cutting bit comprising a shank depending from a head portion with first forward and second rearward retaining portions spaced by a recessed intermediate section includes a cylindrical split sleeve member which extends from said forward retaining portion to said rearward portion to both abut and protect the exposed peripheries of the retaining portions from wear while permitting free rotation of the tool bit within the tool holder.

9 Claims, 2 Drawing Sheets

FIG. 1
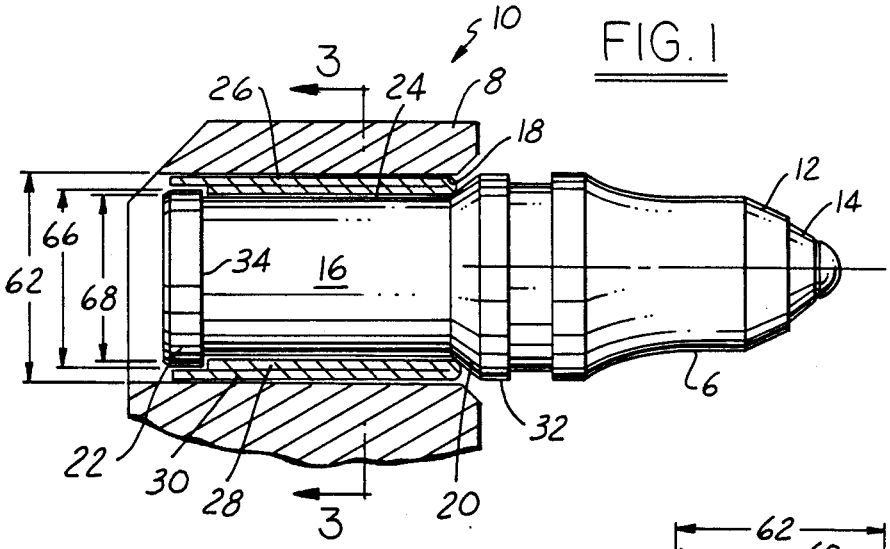
FIG. 2
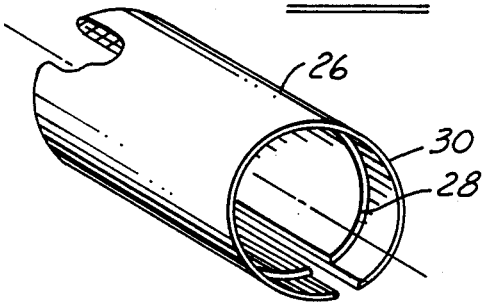
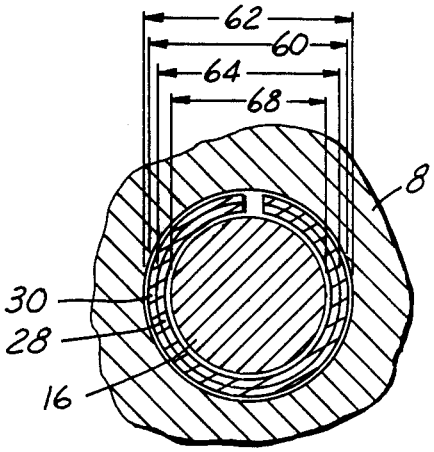
FIG. 3
FIG. 4
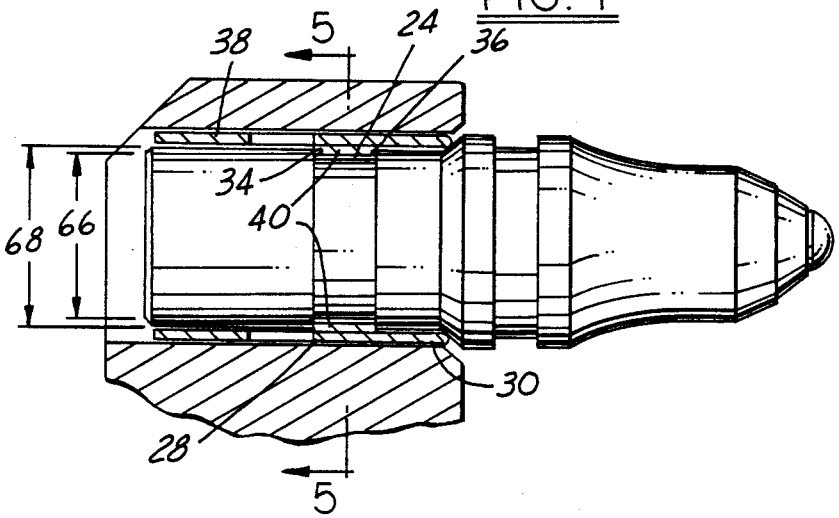

FIG.5
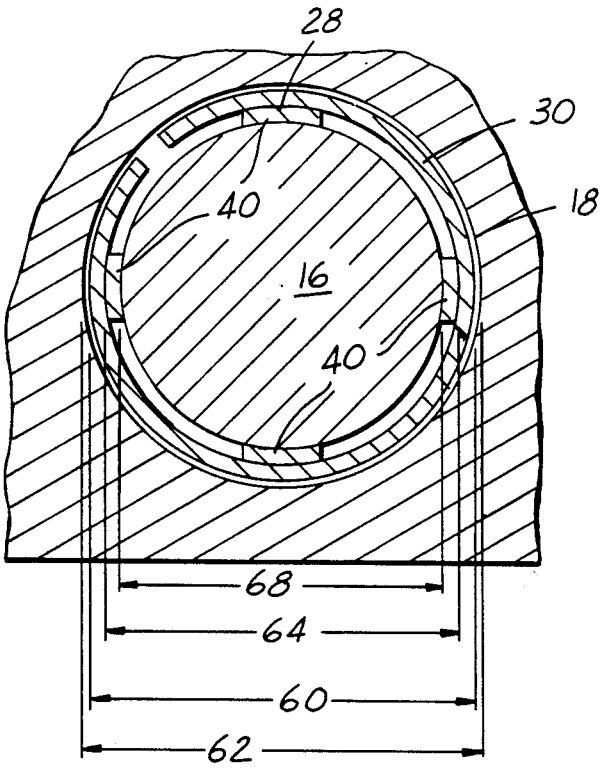
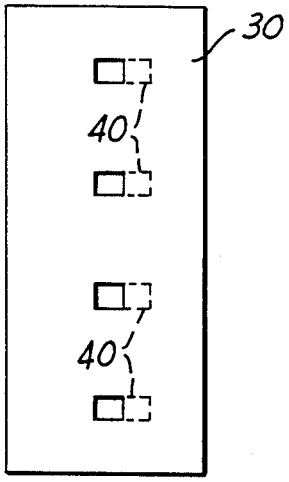
FIG.6
FIG.7
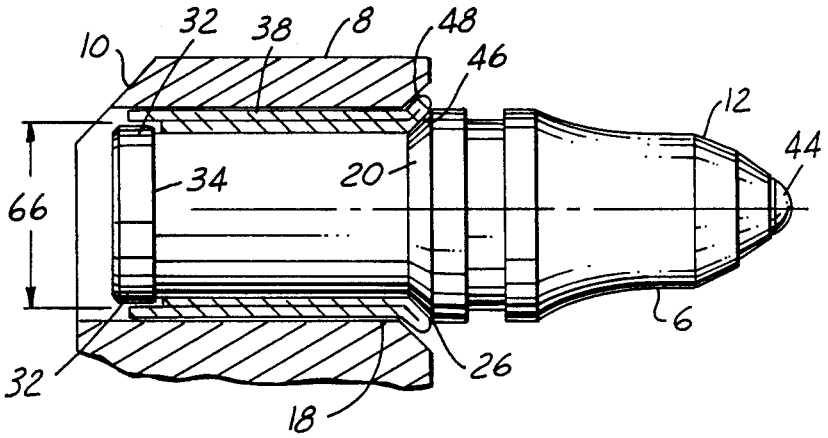

RETAINER SCHEME FOR MACHINE BIT

Co-pending application Ser. No. 944,785, now U.S. Pat. No. 4,728,1 to Cylindrical Retainer For A Cutting Bit was filed on Dec. 22, 1986 and assigned by Ojanen et al to GTE Products Corporation. The application relates to the field of rotatable cutting tools.

1. Field of the Invention

The present invention relates to rotatable cutting tools and more particularly to a flexible sleeve retainer means for removable attachment of a cutting tool within a bored tool holder.

2. Background of the Invention

Tool bits for mining or removing road surfaces are for receipt of replaceable cutting bits. One such tool is disclosed in Ojanen, U.S. Pat. No. 4,497,520, also assigned to GTE Products Corporation. The severe surface conditions encountered during normal operation frequently result in tip fracture or blunting requiring periodic replacement. The cutting tools have to be held securely in place and yet be free to rotate in order to promote uniform wear on the respective tip portions.

Besten, et al, U.S. Pat. Nos. 4,201,421; Rettkowski, 4,247,147; Meyer, 3,663,063; and Emmerich, 4,084,856. These references discuss the use of a split sleeve design which surrounds the shank region of tool bits thereby protecting portions of both the shank and the bore from excessive wear. The sleeve generally sits between and abuts against spaced retainer flanges positioned on the shank. The sleeve being of greater diameter in its unstressed state than the diameter of the bore, lodges securely against the walls of the bore while abutting against the retaining portions of the shank. This design permits free rotation of the tool while holding it securely in place.

Some variations in the general design exist such as seen in Rettkowski where projections on the split sleeve mate with recesses in the bored tool holder to enhance its retaining capacity.

Due to the high pressures encountered in operation, areas of the tool shank unprotected by the tubular sleeve results in both wear to the shank as well as to the tool holder.

Accordingly, an apparatus which alleviates wear problems while retaining the tool bit securely within the tool holder and also permitting free rotation of the tool to promote even tip wear would be a highly desirable advance in the art of machine tool bits.

SUMMARY OF THE INVENTION

In accordance with the present invention there is provided a rotatable cutting tool which comprises a cutting bit, a bit holder having a cylindrical bore for receipt of said bit, with the bore having a first diameter. The cutting bit comprises a head portion which includes a conical tip and a depending shank portion, first and second retaining portions spaced from each other by an intermediate section, where the first portion is positioned axially forward from the second portion toward the head. The retaining portions have a second diameter less than the first diameter and the intermediate section has a third diameter less than the second diameter. A cylindrical split sleeve member extends rearwardly in an axial direction from the first retaining portion to abut with and pass over the second portion thereby restricting bit removal from the bore and protecting the shank portion and bore from wear. The sleeve member has an outer unactivated fourth diameter greater than the first and third diameters.

In accordance with the present invention there is also provided a method for preventing cutting tool wear which comprises expanding a split cylindrical sleeve having outer and inner portions and moving it forward over shank outer retaining portions of the rotatable cutting bit. At least one inner portion of the sleeve abuts against a second end retaining portion thereby positioning an adjoining first outer sleeve portion over the outer peripheral surface of the second retaining portion. Insertion of the cutting tool shank into a cylindrically bored bit holder radially compresses the cylindrical sleeve causing the sleeve to flex radially against the bore preventing axial movement while permitting tool rotation.

One advantage of the present invention as described above is the ability to use a single tool within a wide range of bore sizes by employing retainer sleeves of varying thicknesses and diameters.

Another advantage is that wear on the bore wall of the tool holder due to surface contact with the tool shank is minimized by the extension of the retainer sleeve over the retaining portions.

The present invention also provides a simple method of removably fixing rotatable cutting tools within a bored tool holder which is also easy to manufacture.

BRIEF DESCRIPTION OF THE DRAWINGS

The objects, features and advantages of the present invention will be clearly understood to those skilled in the art by reference to this disclosure and the attached drawings in which:

FIG. 1 is a partially sectioned view of a bit mounted block; D-85-2-123

FIG. 2 is a perspective view of the split sleeve member;

FIG. 3 is a cross-sectional view along line CC of FIG. 1;

FIG. 4 is a partially sectioned view as in FIG. 1 of an alternate embodiment;

FIG. 5 is a cross-sectional view along DD of FIG. 4;

FIG. 6 is a top view of a flattened split sleeve member; and

FIG. 7 is a partially sectioned view as in FIG. 1, of an alternate embodiment.

DETAILED DESCRIPTION OF THE PREFERRED EMBODIMENT

The embodiment of this invention which is illustrated in FIG. 1 is particularly suited for achieving the objects of this invention.

FIG. 1 shows a rotatable cutting tool 10 with a cutting bit 6 including a head portion 12, a conical tip 14 and a depending shank 16. The shank portion is mounted in a cylindrically bored bit holder 18 having a first diameter 62.

The shank portion 16 includes first 20 and second 22 retaining portion separated on shank 16 by a recessed intermediate section 24 with the first retaining portion 20 positioned axially forward on the shank toward the head portion 12. The first and second retaining portions have a second diameter 66 greater than the diameter 68 of the intermediate section 24 but less than the first diameter of the first bore 62. This is to ensure the free rotation of the bit when mounted in the tool holder bore.

A split cylindrical sleeve 26 is positioned around the shank portion 16 of the cutting tool 10 extending axially from the first retaining portion 20 rearwardly, where it abuts against the forward face 34 of at least a second retaining portion 22 and extends therefrom, fully protecting the retaining portion periphery 32 and restricting bit removal from bore 18.

Sleeve 26 includes a first outer sleeve 30 and at least one adjoining inner portion 28 (See FIG. 2). The inner portion is shorter in length than the outer sleeve to take advantage of the abutting face 34 of at least the second retaining portion 22 while still protecting its outer periphery 32.

The sleeve material may be composed of any resilient material commonly known in the art which is sufficiently durable to withstand the pressures and force encountered in cutting tool operations. One example which meets these criteria is spring steel.

Outer sleeve 30 has an unactuated fourth diameter 60 which is greater than first diameter 62, second retainer diameter 66 or the third intermediate section diameter 68. When compressed within bore 18, outer sleeve 26 allows for the secure retainment of shank 16 thereby permitting the use of a single tool holder in conjunction with cutting tools of various dimensions for a variety of work surfaces.

The diameter of the first inner sleeve 64 of FIG. 3, in its activated or compressed state is less than diameter 66 of the retaining portion 22 to facilitate abuttment and retainment of the bit 6 when mounted in the bore 18. The total thickness of the cylindrical sleeve 26 depends in part upon the diameter of the retaining portions in relation to the shank diameter and the toughness of the surface condition applied thereto. Excessively harsh conditions often necessitate sleeves of slightly thicker dimensions to withstand the additional forces encountered. Sleeve 26 must be sufficiently thick to protect the retaining portions and bore from wear and yet permit free rotation of the tool when mounted in bore 18.

The split circular sleeve portion 26 of FIG. 1, fitted around the tool shank 16 and inserted within the bore 18, is preferably separated from the shank by a mean distance of between about 10 thousandths and about 30 thousandths of an inch. A smaller spacing may result in wear on the shank 16 and retainer portions 20, 22 due to frictional scoring by contamination build up.

In an alternate embodiment cylindrical sleeve 26 is positioned around shank portion 16 where it abuts against faces 34, 36 and extends axially to the ends of the retaining portions 20, 22, fully protecting the outer peripheries 32 from wear.

In still another embodiment, the inner sleeve portion 28 may comprise single or multiple tabs 40 formed out of the first outer sleeve 30 material. The tab portions may be manufactured by any standard technique known in the art including mechanical stamp pressing for cutting and pressing the tabs, followed by rolling on standard four slide machines and heat treatment.

The tabs 40, as seen in FIG. 4, are arranged in an inner ring which abut faces 34 and 36 bordering intermediate section 24. This method provides single or multiple abutment points against retaining portions 20 and 22 forgoing the need for additional manufacturing steps, i.e. such as welding an inner portion 28 to an outer sleeve 30 and rolling into a sleeve member. In addition, use of an inner tab portion 40 allows for the use of an intermediate section 24 between the flanged retainer portions of reduced axial distance. Machining costs for the tool shank may therefore be reduced.

The tab portions 40 seen in FIG. 4 are pressed out of resilient material and are generally rectangular in shape having a length greater than width. The number of tabs formed depends on the type of resilient material employed and the width of each tab. Using spring steel, a preferred number of tabs is limited structurally to no more than a total pressing of 50% of the steel falling within the dimensions of the recessed intermediate section 24 of the shank 16. The removal of additional steel beyond this point may begin to compromise the structural integrity of the sleeve when in operation.

In yet another embodiment, seen in FIG. 7, tool holder 8 maintains a flared conical entry portion 48 to bore 18. The cylindrical sleeve 26 is also conically flared and may extend forwardly along axis 44 toward the head portion 12 separating the first retaining portion 20 from the conical lip portion 46. In this way both the shank portion 16 of the bit 6 and the tool holder mount 8 are protected from wear encountered during normal operation.

The present invention also includes a method for preventing cutting tool wear in which cylindrical sleeve 26 is expanded and moved axially forward toward the head 12, fully covering the periphery 32 of second retaining portion 22. Once positioned over the intermediate section 24, at least part of the shorter inner sleeve portion 28 abuts against the forward end face 34 of the second end retaining portion 22 preventing the cutting tool 10 from forward motion in relation to the sleeve 26. When the sleeve is in its unactivated or uncompressed state, the shank portion 16 rotates freely within the sleeve portion 26. The longer first outer sleeve portion 30 adjoining D-85-2-123 inner portions 28, extends rearwardly beyond the abutting plane 34 of the second rear retaining portion 22 fully protecting its periphery 32 from wear.

The sleeve 26 is compressed inwardly in a radial direction towards the rotational axis 44 of the cutting tool 10 by contact with the surface of the bore 38. When mounted, the compressive force of the activated cylindrical sleeve 26 flexes against the bore preventing axial movement while permitting tool rotation. Inner portions 28 contact abutting faces 34, 36 of the retainer portions 20, 22 thereby restricting longitudinal movement of the tool within the bore 18 and therefore preventing premature removal during use.

Since variations of this invention will be apparent to those skilled in the art, it is intended that this invention be limited only by the scope of the appended claims.

What is claimed is:

1. A rotatable cutting tool which comprises: a cutting bit, a bit holder having a cylindrical bore for receipt of said bit, said bore having a first diameter, said cutting bit comprising a head portion including a conical tip and a depending shank portion and first and second retaining portions spaced from each other by an intermediate section, said first portion positioned axially forward from said second portion toward said head portion, said retaining portions having a second diameter less than said first diameter, said intermediate section having a third diameter less than said second diameter, a cylindrical sleeve member rearwardly extending in an axial direction from said first retaining portion to abut with and pass over the second one of said retaining portion periphery thereby restricting bit removal from the bore and protecting said shank portion from wear, said sleeve member having an unactivated fourth diameter greater than said first diameter.

2. A rotatable cutting tool according to claim 1 wherein said cylindrical sleeve has a first outer sleeve and a second inner portion of shorter length which adjoins said first sleeve.

3. A rotatable cutting tool according to claim 2, wherein at least one adjoining second inner portion abuts with at least one of said retaining portions.

4. A rotatable cutting tool according to claim 2 wherein said second inner portion abuts said second retaining portion while inserted within said bore.

5. A rotatable cutting tool according to claim 4 wherein said cylindrical sleeve is flared at one end to form a conical portion to protect said first retaining portion from wear.

6. A rotatable cutting tool according to claim 5 wherein said cylindrical sleeve is of sufficient thickness to protect said retaining portion from contact with said bore and yet permit rotation of the tool while inserted in the bore.

7. A rotatable cutting tool which comprises: a cutting bit, a bit holder having a cylindrical bore for receipt of said bit, said bore having a first diameter, said cutting bit comprising a head portion including a conical tip and a depending shank portion and first and second retaining portions spaced from each other by an intermediate section, said first portion positioned axially forward from said second portion toward said head portion, said retaining portions having a second diameter less than said first diameter, said intermediate section having a third diameter less than said second diameter, a cylindrical split sleeve member of resilient material extending rearwardly from said first retaining portion to the end of said second retainer portion periphery protecting said bore from wear, said sleeve having a first outer sleeve and at least one adjoining inner portion of shorter length, said inner portion in abutting engagement with said adjoining second portion while engaged within said bore thereby restricting bit removal, said cylindrical sleeve being of sufficient thickness to protect said first portion from contact with said bore and yet permit rotation of the tool to allow for uniform tip wear, said sleeve member having an unactivated fourth diameter greater than said first and third diameters.

8. A rotatable cutting tool according to claim 7 wherein said bit holder includes a conical entry portion tapering in a rearward axial direction into said bore.

9. A rotatable cutting tool according to claim 8 wherein said cylindrical sleeve is flared at one end to form a conical portion to protect said first retaining portion from wear.

* * * * *